US006361397B1

(12) United States Patent
Mankovitz et al.

(10) Patent No.: US 6,361,397 B1
(45) **Date of Patent: *Mar. 26, 2002**

(54) GARMENTS WHICH FACILITATE THE DRAINAGE OF LYMPHATIC FLUID FROM THE BREAST AREA OF THE HUMAN FEMALE

(75) Inventors: Roy J. Mankovitz, 24236 Park Granda, Calabases, CA (US) 91302; Kimberlee Cozby Muenzer, La Canada, CA (US); Spencer Mackay, Agoura Hills, CA (US)

(73) Assignee: Roy J. Mankovitz, Calabasas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/476,835

(22) Filed: Jan. 3, 2000

Related U.S. Application Data

(63) Continuation-in-part of application No. 09/290,020, filed on Apr. 9, 1999, now Pat. No. 6,086,450
(60) Provisional application No. 60/096,418, filed on Aug. 13, 1998.

(51) Int. Cl.[7] ..... A41C 3/00
(52) U.S. Cl. ..... 450/20; 450/1
(58) Field of Search ..... 450/20, 1, 44, 450/65–68, 70–72, 74–76, 19–21, 38–40, 57–58; 2/69; 601/1, 14, 151; 602/19, 41, 60, 61, 63

(56) References Cited

U.S. PATENT DOCUMENTS

| | | | | | |
|---|---|---|---|---|---|
| 1,994,941 | A | * | 3/1935 | Caldor | 450/1 |
| 2,824,563 | A | | 2/1958 | Hill | |
| 2,864,372 | A | | 12/1958 | Buckley | |
| 3,190,292 | A | * | 6/1965 | Barnes | 450/76 |
| 3,254,653 | A | * | 6/1966 | Krieger | 450/1 |
| 3,459,190 | A | * | 8/1969 | Frischer et al. | 450/41 |
| 3,491,762 | A | * | 1/1970 | Simonsen | 450/88 |
| 4,955,909 | A | | 9/1990 | Ersek et al. | |
| 4,957,466 | A | * | 9/1990 | Hopps | 450/85 |
| 5,014,681 | A | * | 5/1991 | Neeman et al. | 450/1 |
| 5,429,593 | A | * | 7/1995 | Matory | 450/58 |
| 5,522,892 | A | | 6/1996 | Lin | |
| 5,538,502 | A | * | 7/1996 | Johnstone | 450/1 |
| 5,782,671 | A | | 7/1998 | Suen et al. | |
| 5,800,245 | A | | 9/1998 | Barbe-Vicuna et al. | |
| 5,940,888 | A | | 8/1999 | Sher | 2/267 |
| 5,944,579 | A | | 8/1999 | Fleischman | |
| 6,086,450 | A | * | 7/2000 | Makovitz | 450/20 |

* cited by examiner

*Primary Examiner*—Gloria M. Hale
(74) *Attorney, Agent, or Firm*—Gifford, Krass, Groh, Sprinkle, Anderson & Citkowski, PC

(57) ABSTRACT

Bosom-support garments such as brassieres reduce interference with lymph flow. A garment according to the invention includes a piece of flexible material which when worn, covers at least a portion of a human female breast, along with means for temporarily relaxing or repositioning the garment relative to the lymph drainage pathways while the garment is worn. The means for temporarily relaxing or repositioning the garment may be passive, in the sense that such means operate through movements by the wearer of the garment, or active, in that manually or automatically operated apparatus are used to control the relaxing or repositioning of the garment.

19 Claims, 8 Drawing Sheets

GARMENTS WHICH FACILITATE THE DRAINAGE OF LYMPHATIC FLUID FROM THE BREAST AREA OF THE HUMAN FEMALE

REFERENCE TO RELATED APPLICATION

This application is a continuation-in-part of U.S. patent application Ser. No. 09/290,020, filed Apr. 9, 1999, now U.S. Pat. No. 6,086,450 which claims priority of U.S. provisional application Serial No. 60/096,418, filed Aug. 13, 1998, the entire contents of both are incorporated herein by reference.

FIELD OF THE INVENTION

This invention relates generally to female bosom support garments and, in particular, to brassieres which allow or promote the drainage of lymphatic fluid from the breast area of a human female.

BACKGROUND OF THE INVENTION

Breast cancer has become a major health problem among the adult female population in the Western world. It is interesting to look at anthropological studies in an attempt to ascertain causes of this problem which may be related to our modern-day lifestyle.

Medical anthropologist Sidney Ross Singer hypothesized that a link may exist between breast cancer and brassieres. He conducted a study to examine the history, attitudes, and behaviors of women with and without breast cancer in five major cities across the U.S. From 1991 to 1993, Singer and Soma Grismaijer interviewed over 4700 women and found a significant correlation between the breast cancer risk factor and the number of hours per day women wore brassieres. The results of the study are presented in the book "Dressed to Kill," by Sidney Ross Singer and Soma Grismaijer, Avery Publishing Group, 1995.

In FIG. 1 there is shown a conventional brassiere, comprising a support band which encircles the torso under the breasts, and which is usually fastened in the back. Two cups are attached to the band, and shoulder straps connect between the top of each cup and the rear portion of the support band. It has been hypothesized that conventional garments of this type constrict blood circulation and impede lymphatic flow. The largest mass of lymph nodes in the upper body is located in an area extending up from the breast to just under the arm. These nodes drain lymph from the breast area into the thoracic duct, which flows to the heart. By suppressing the flow of lymph, brassieres may cause toxins to accumulate in the tissues of the breasts which, in turn, might be responsible for creating an environment conclusive to the formation of breast cancer.

U.S. Pat. No. 5,800,245 discloses a compression brassiere and pad for manual lymph drainage. The objective appears to be to minimize the accumulation of lymph in the breast area between weekly sessions of lymph massage be applying continuous compression to various portions the breast area. The inventor of the present invention believes that the application of continuous compression in these areas is in fact highly undesirable, since such compression is more likely to contribute to the constriction of lymph flow.

It is a hypothesis of the present invention that the conventional designs of brassieres do indeed impede the drainage of lymph fluid from the breast area, and that such impeded flow may increase the risk of developing breast cancer. It is therefore an object of the present invention to provide brassieres which support the wearer's breasts, but are also designed to aid the drainage of lymph fluid from the breast and surrounding tissue.

SUMMARY OF THE INVENTION

The subject invention resides in bosom-support garments designed to reduce interference with lymph flow as compared to prior-art designs, which act to provide large areas of breast compression which cross over and clamp down on lymph pathways, thereby restricting flow. Although the detailed description is directed toward a traditional brassiere having relatively narrow straps and a rear closure, the invention is applicable to any breast-covering or -supporting garments such as bustiers, corsets, swim apparel, and so forth, regardless of the closure configuration.

In broad and general terms, a garment according to the invention includes a piece of flexible material which, when worn, covers at least a portion of a human female breast, along with means for temporarily relaxing or repositioning the garment relative to the lymph drainage pathways while the garment is worn. The means for temporarily relaxing or repositioning the garment may be passive, in the sense that such means operate through movements by the wearer of the garment, or active, in that manually or automatically operated apparatus are used to control the relaxing or repositioning of the garment. Both passive and active relaxing/repositioning means are disclosed and described in detail.

In a preferred embodiment, the means for temporarily relaxing or repositioning the garment includes at least one module supported on the garment to produce a tactile signal which is felt by the wearer on a periodic basis. The module is preferably is removable to permit laundering of the garment, and may be used to stimulate the flow of lymphatic fluid, and/or to alert the wearer that the garment should be worn over extended periods.

According, to a different embodiment, the means for temporarily relaxing or repositioning the garment includes one or more insets composed of an elastic fabric which is substantially more stretchable than the flexible material of the garment itself, such that the flexible material moves relative to the lymph drainage pathways while the garment is worn. In a further embodiment, means are provided for temporarily loosening then returning the garment to its original tightness when worn. In this case, manually operated release points are preferably provided at the shoulder straps and/or at the side panels.

In another configuration, the peripheral edges of the side panels, back strap, and shoulder straps are composed of a soft and flexible material to avoid restriction against the wearer's skin. In addition, the widths of the side panels, back strap and shoulder straps are preferably scaled in accordance with increasing cup size.

In yet a different configuration the material of the garment includes a pattern of alternating higher and lower skin-compression areas which correspond to the lymph drainage pathways, and the means for temporarily relaxing or repositioning the garment includes means for adjusting the pattern when the garment is worn. In one disclosed example, air or liquid bladders are employed which fill and empty in sequence. The bladders are preferably arranged radially outwardly from the center to the outside of each breast. In a different disclosed example, the material includes a pair of cup portions featuring pattern of alternating higher and lower skin-compression areas is in the form of ribs which radiate out from a central portion of each cup portion. In this case, an insert is provided, which may be removeably applied to existing garments, enabling the ribs to be manually rotated or otherwise translated on a periodic basis by the wearer.

DETAILED DESCRIPTION OF THE INVENTION

Figure 2:
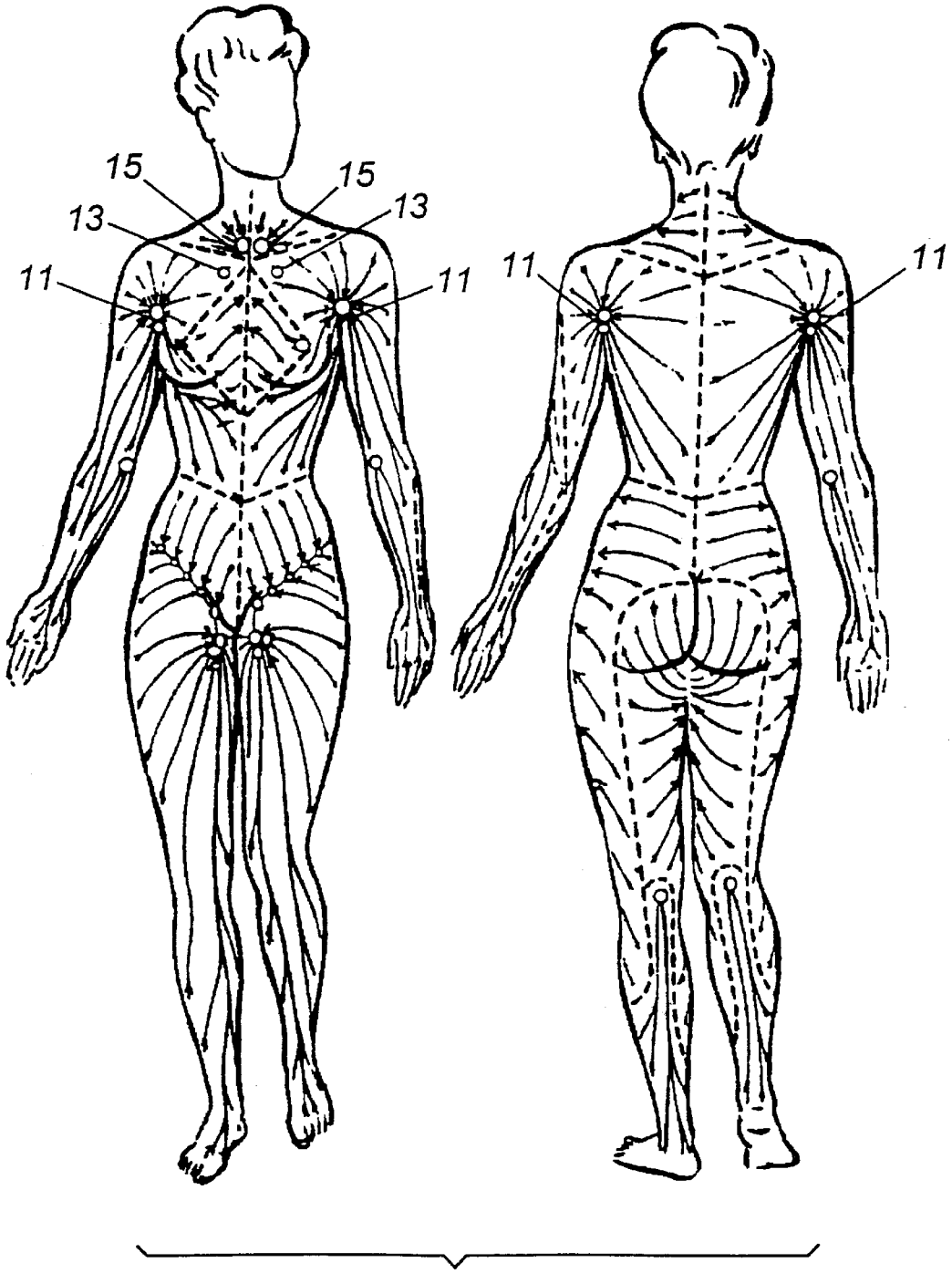
FIG. 2 is a schematic representation of the lymph drainage pathways in a human female.

Referring to FIG. 2, there is shown a schematic representation of the lymph drainage pathways in a human female. Of particular interest are the collecting lymph nodes in the upper portion of the body: the auxiliary nodes 11 under the armpits, the subclavicular nodes 13, and the terminus 15. These nodes and the lymph flow patterns in the breast area are more clearly shown in FIG. 3, which is a diagram of the lymph drainage from the head, neck and breast area. If the breast is divided into four quadrants as shown by the lines radiating from the nipple 17 in the figure, then it can be seen that the lymph from the upper and lower outer lateral quadrants drains to the auxiliary nodes 11. The lymph from the medial upper quadrant drains to the subclavicular nodes 13, and then to the terminus 15. Lymph from the lower medial quadrant flows pasternally into the intercostal space and on the inner thorax wall along the costal arch to the spinal column and then into the thoracic duct. In general in the breast area, the direction of lymph fluid drainage is upward. The lymph fluid moves in response to torso movement and muscle contraction, and the lymph system contains several check valves to prevent backflow.

Figure 1:
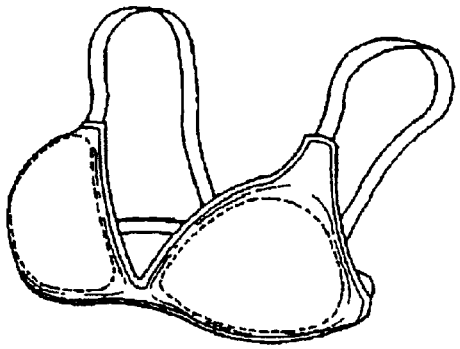
Fig - 1 (PRIOR ART)
FIG. 1 is an oblique representation of a conventional brassiere, comprising a support band which encircles the torso under the breasts, generally fastened in the back.
Figure 4:
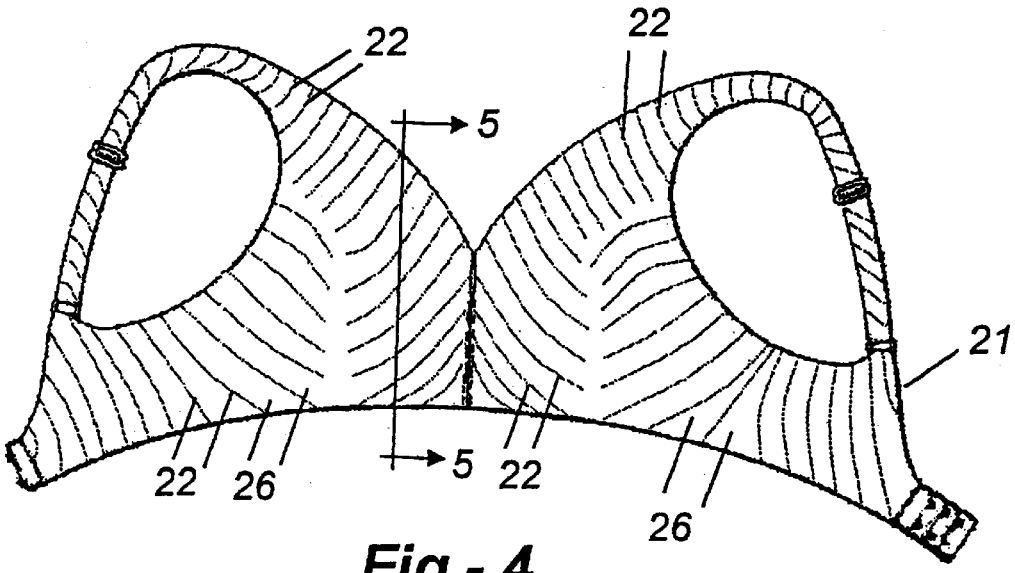
FIG. 4 is a front plan view of the brassiere according to a first preferred embodiment of the invention, which opened up to show all sections.

A first preferred embodiment of a brassiere 20 constructed in accordance with the present invention is shown in FIG. 4, which is a front plan view of the brassiere opened up to show all sections. The intention of this design is to decrease the restriction of lymph flow from that caused by wearing a brassiere of conventional design such as shown in FIG. 1. In this embodiment, the conventional brassiere shape is substantially maintained, but the material comprising the brassiere comprises a base material 21 to which are attached a plethora of spaced apart ribs 22. The lines 22 shown in FIG. 4 represent the ribs, the construction of which is more clearly shown in FIG. 5, which is a cross-sectional view of the brassiere of FIG. 4, taken along the line 5—5.

Figure 5:
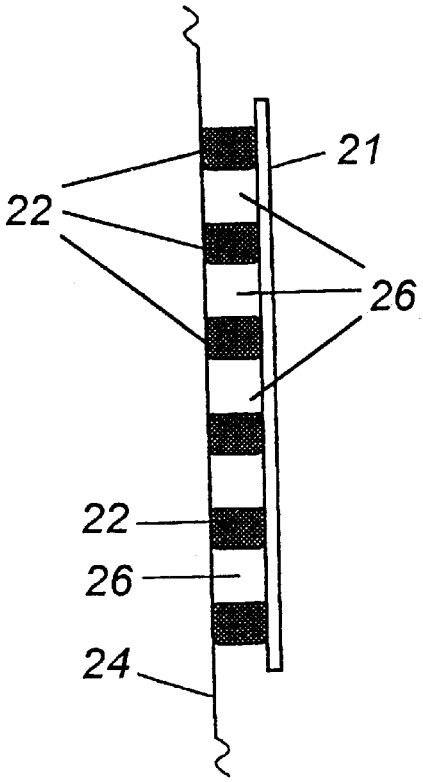
FIG. 5 is a cross-sectional view of spaced-apart ribs designed to contact the surface of the skin of the wearer while leaving spaces or pathways between the ribs where no material is in contact with the skin.

Referring to FIG. 5, the ribs 22 are spaced apart along the base material 21, and are designed to contact the surface of the skin 24 of the wearer, while leaving spaces or pathways 26 between the ribs where no material is in contact with the skin. As will become more apparent from the following discussion, the spaces 26 are designed to provide areas where no constriction of or pressure on the lymph ducts occurs, so that unimpeded drainage of lymph fluid may take place. The ribs 22 may be formed by weaving or pressure-formation as part of the base material 21 resulting in a pattern similar to corduroy. Alternatively, the ribs 22 may be formed as pockets or cells filled with a solid such as foam, or a liquid or a gas having sufficient internal pressure to maintain the pathways 26 when the brassiere 20 is worn.

Figure 6:
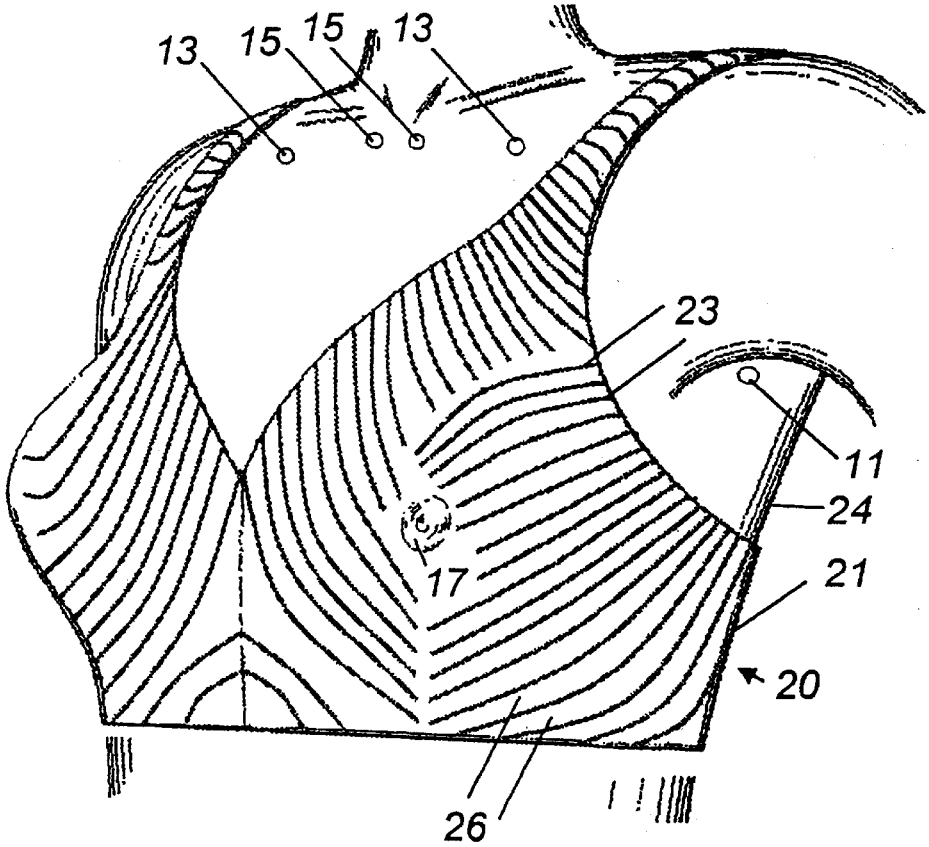
FIG. 6 illustrates brassiere according to the invention in place on a wearer, where it may be seen that ribs in combination with intercellular spaces provide pathways shaped to follow or conform to a woman's lymph drainage pathways.

Referring now to FIG. 6, which shows the brassiere 20 in place on a wearer, it may be seen that the ribs 22 in combination with the intercellular spaces 26 act to provide pathways 26 which are shaped to follow or conform to the lymph drainage pathways shown in FIG. 2 and described above. Thus, the ribs 22 in the upper and lower outer lateral quadrants around the area of the nipple 17 are shaped to provide drainage pathways 26 toward the auxiliary nodes 11. The ribs 22 in the area of the medial upper quadrant are shaped to provide drainage pathways 26 toward the subclavicular nodes 13, and then to the terminus 15. The ribs 22 in the area of the lower medial quadrant are shaped to provide drainage pathways 26 toward the intercostal space.

Figure 7:
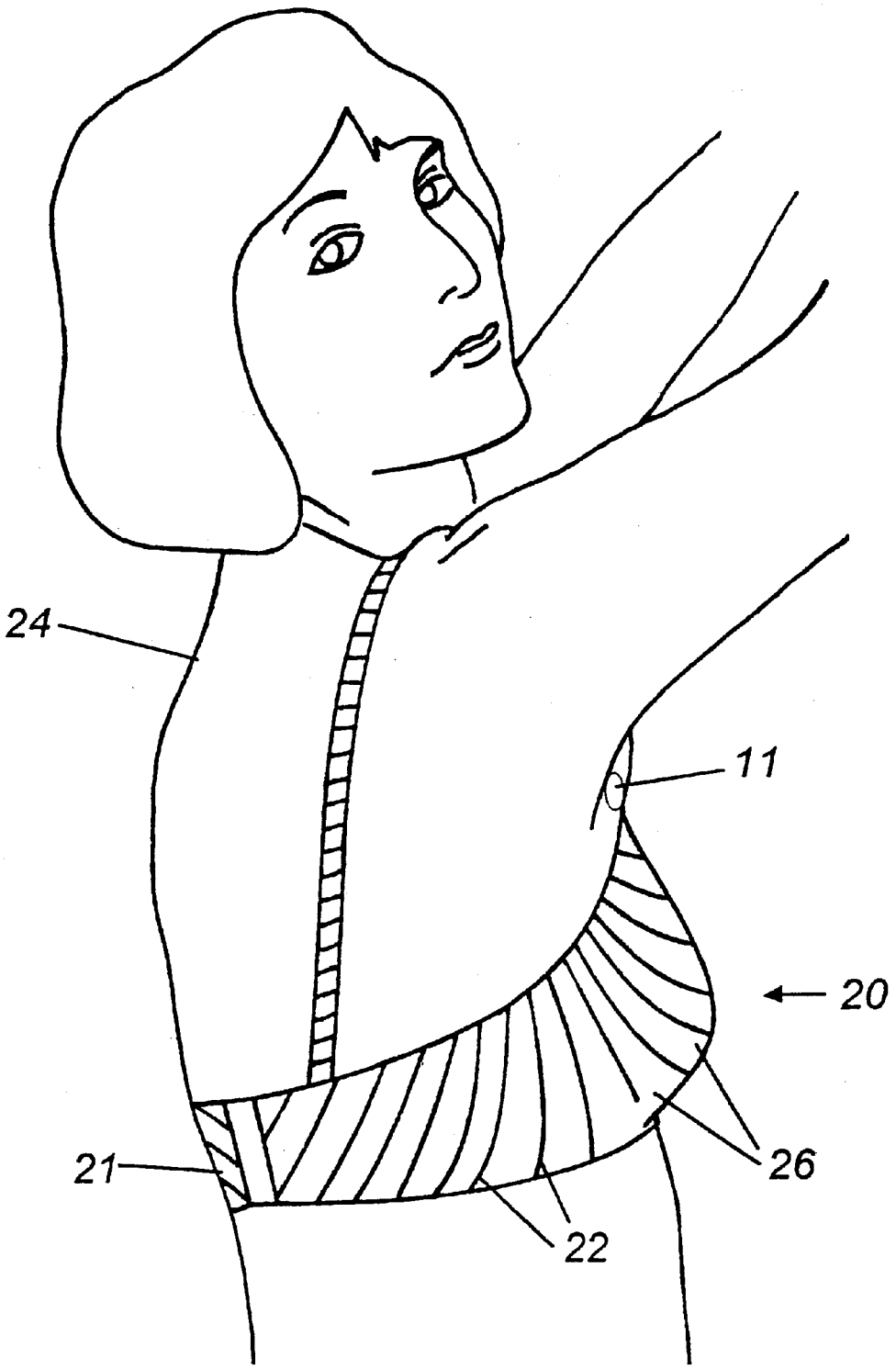
FIG. 7 provides rear and side views of the brassiere of FIG. 6.

FIG. 7 is a rear and side view of the brassiere 20 when in place on a wearer. Note that the preferred shape of the ribs 22 in the sides and back of the brassiere 20 is such as to provide pathways from the underarm and the back toward the auxiliary lymph node, in keeping with the pathways shown for the flow of lymph in these areas delineated in the posterior view of FIG. 1.

Figure 8:
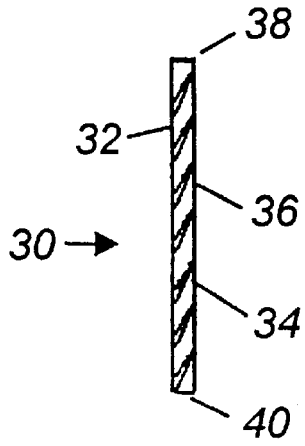
FIG. 8 depicts an alternative embodiment of the invention wherein a plurality of semi-rigid plastic nibs or fingers are integrally molded into an inner surface to provide a massaging action when the garment is worn.

In a second preferred embodiment of the invention, the conventional brassiere shape of FIG. 1 is also substantially maintained, but the material comprising the brassiere is formed of a sandwich 30 as shown in FIG. 8. An outer wall 32 of the sandwich is provided of a flexible and moldable material such as plastic which has a plurality of semi-rigid plastic nibs or fingers 34 integrally molded into an inner surface thereof. The axes of the fingers are oriented upward at an angle of between 45 and about 60 degrees from the horizontal. The sandwich further includes an inner wall 36 which is designed to lie against the wearer's skin and which is substantially parallel to the outer wall and may be fabricated of a soft textile material. The ti ps of the fingers rest upon the inner surface of the inner wall as shown. The outer and inner walls are joined together at the top 38 and bottom 40 of the respective brassiere sections in a manner which allows the outer wall to translate up and down about ¼ of an inch with respect to the inner wall. The shoulder straps of the brassiere are attached to of the outer wall 32 of the sandwich material, which forms the support band as well as the cup portion of the brassiere.

The operation of this embodiment is as follows, there n the user is wearing the brassiere, upward arm and shoulder motion as a result of normal body movement during the day causes the shoulder straps to periodically pull up on the outer wall of the fabric, which causes the semi-rigid fingers 34 to press against and slide upward aloof the inner wall hence exerting a generally upward force on the wearer s skin. This force gently massages the lymph ducts, helping to push the lymph fluid in the desired upward direction as shown in FIGS. 1 and 2. When the user's arms and shoulders are lowered, the outer wall slides down with respect to the inner wall, and because of the orientation of the fingers, very little pressure is exerted by them on the inner wall and skin surface of the wearer. Thus, from the daily movements of the wearer, there is a net upward pressure differential created against the skin, and hence lymph ducts under the skin, to assist in lymph drainage.

Figure 9:
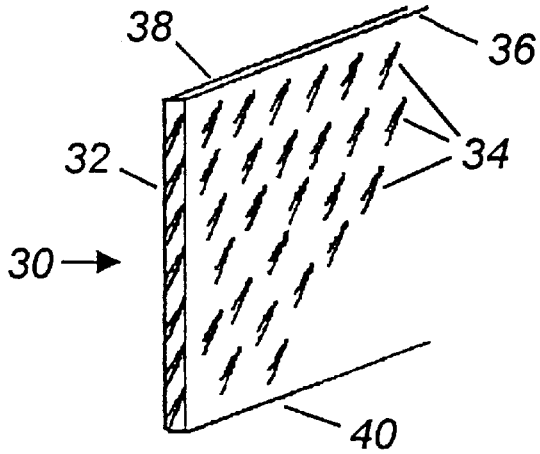
FIG. 9 is a perspective view of the embodiment of FIG. 8, showing how the orientation of the nibs or fingers may be shifted from vertical to align with the lymph ducts in a particular duct area.
Figure 3:
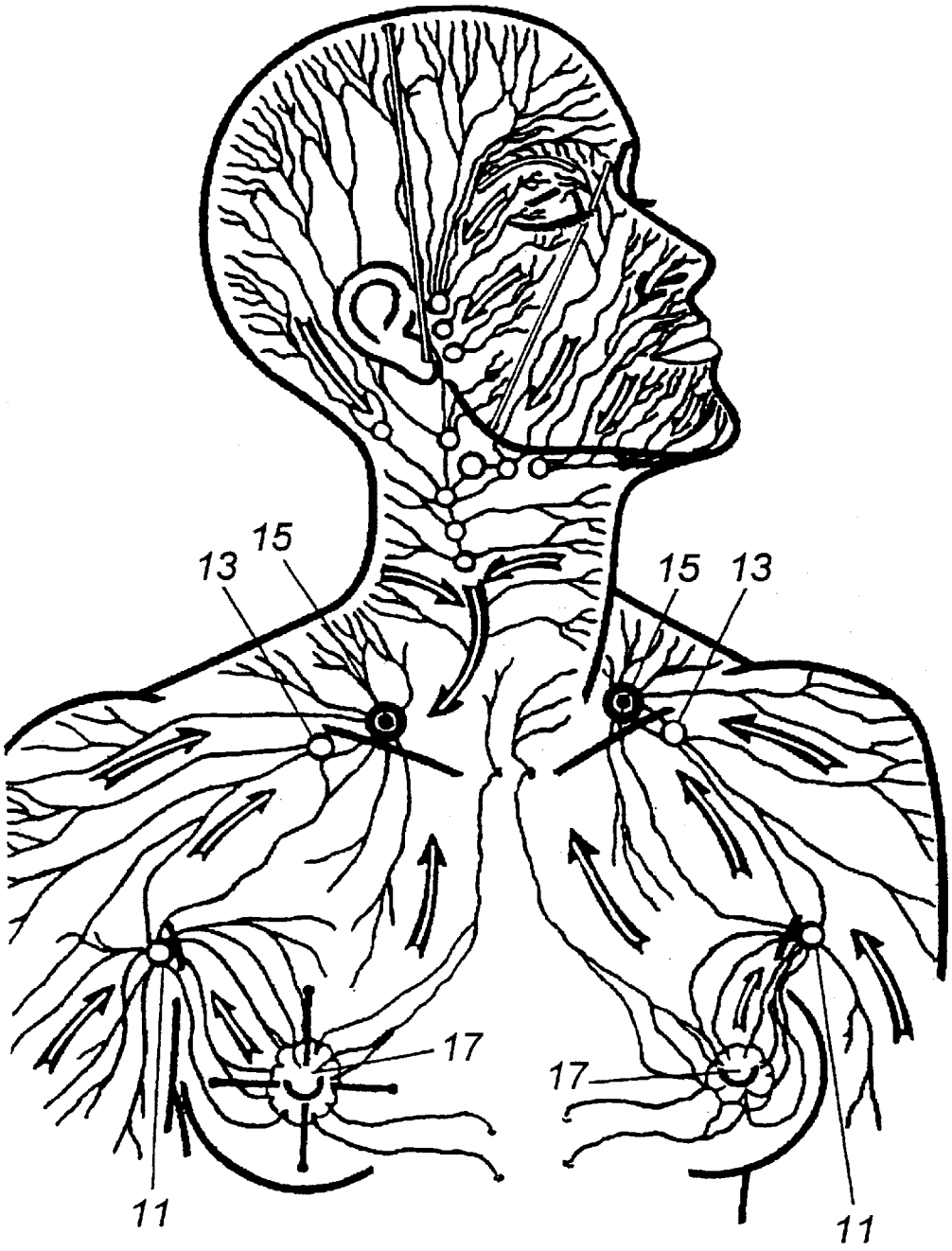
FIG. 3 is a diagram of the lymph drainage from the head, neck and breast area.

As previously described with respect to FIGS. 2 and 3, the direction of flow of lymph varies in angle at various locations around the breast and back area. Accordingly, the orientation of the fingers 34 in the sandwich material 30 is varied in the construction of the brassiere, depending upon the location of the material with respect to the lymph ducts, so that the axes of the fingers in any particular area will be as parallel as practical with the lymph ducts in that area. FIG. 9 is a perspective view of the sandwich 30 showing how the finger orientation may be shifted from vertical to align with the lymph ducts in a particular duct area.

Figure 10:
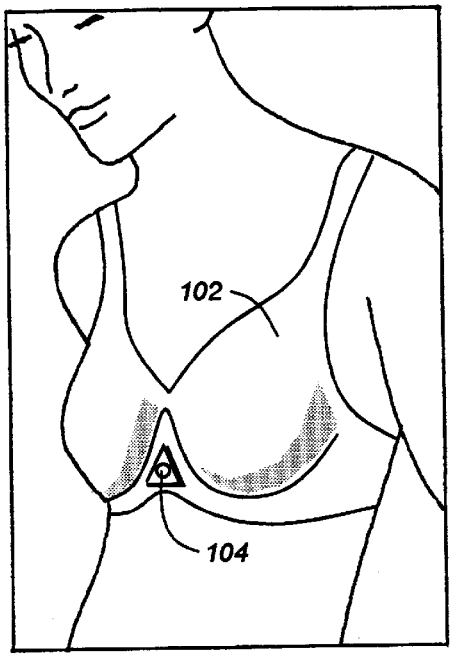
FIG. 10 is a drawing of an alternative embodiment of the invention including an indicator, preferably tactile in nature, which reminds the wearer of a bra not to keep the garment on for too long and/or to vibrate at least of the portion of the article to promote flow of lymphatic fluid.

FIG. 10 is a drawing which shows an alternative brassiere 102 according to the invention, including one or more removable modules 104 used to remind the wearer not to keep the garment on for too long and/or, to vibrate or reposition at least a portion of the garment so as to stimulate the flow of lymphatic fluid. The module 104 preferably produces a signal which is tactile is nature, and may take the form of vibrators of the type used in silent pagers or other, preferably discrete, buzzers, or the like. Battery-operated electronics are also be included in the design, preferably supported on the garment as well, including operator controls to set the delay between vibrations and, perhaps, the length of the vibration itself. The signal generator, electronics and replaceable battery would be located in a removable module, with a VELCRO, hook and loop fastener, or other appropriate fastener, enabling the module to be removed when the garment is laundered.

If used to remind a wearer of the article 102 that the article should not be worn for extended periods of time, the garment may further include a label to that affect, preferably informing the wearer of the preferred wearing time for that particular garment, and such time period would preferably be coordinated with the period between activations of the module 104. If used to vibrate the garment, it will be appreciated that the signal generator of module 104, preferably in the form of a vibrator, could be used in conjunction with any of the other structures disclosed herein, particular those having ribs or other features to conduct the oscillatory motion. To distribute such oscillations, multiple modules may be located at strategic points of lymphatic flow relative to the wearer's body.

Figure 11A:
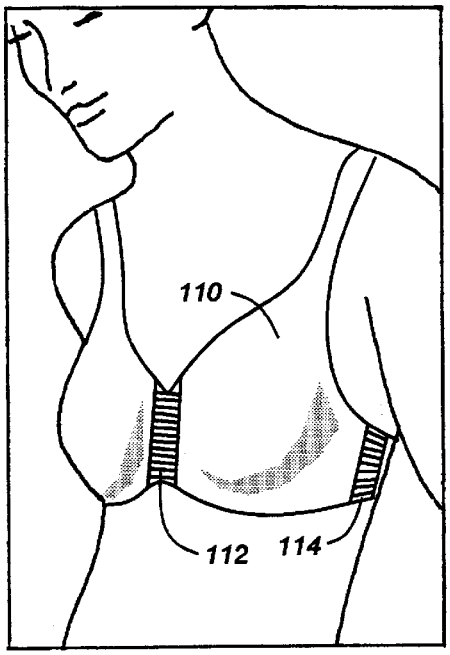
FIG. 11A is a drawing which shows how stretchable fabric may be incorporated into a brassiere to minimize restrictions to the flow of lymph.
Figure 11B:
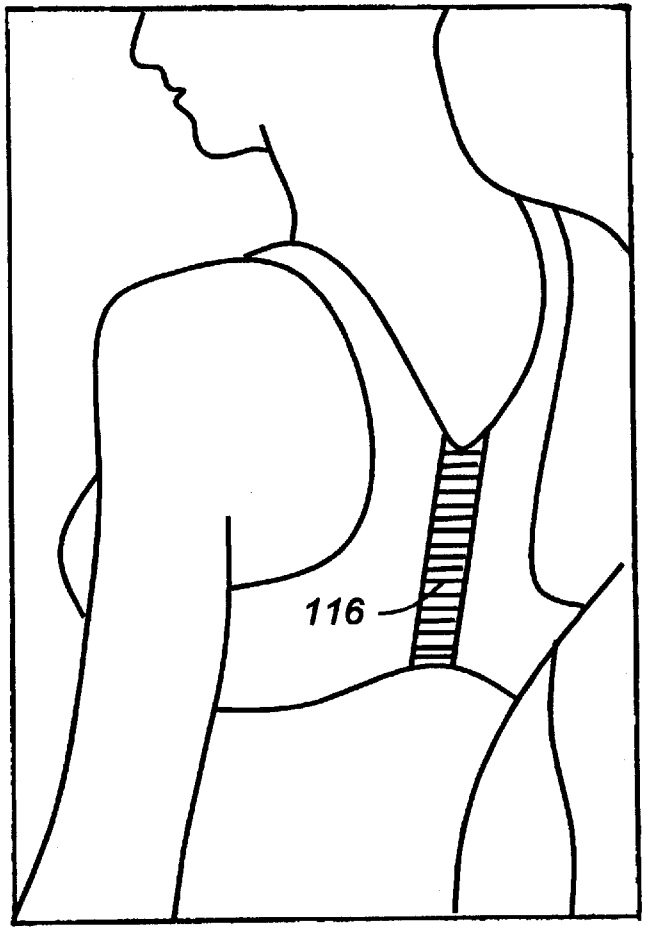
FIG. 11B is a drawing showing a back view of the garment of FIG. 11A.

FIGS. 11A and 11B show an alternative embodiment of the invention, in the form of a brassiere 110 having one or more insets 112, 114 and 116 composed of a very stretchable elastic fabric. Since the lymph system has no pump, it relies on the movement of the body. As such, besides restricting the flow of lymphatic fluid, brassieres may also inhibit a full range of movement. For example, straps tend to slip off, so a person wearing such a garment learns to restrict movement to keep them in place. In addition, tight support bands inhibit the expansion of the rib cage when breathing. The embodiment of FIGS. 11A and 11B therefore encourage movement with the placement of the straps, as shown, in the insets of stretchable fabric.

Figure 12:
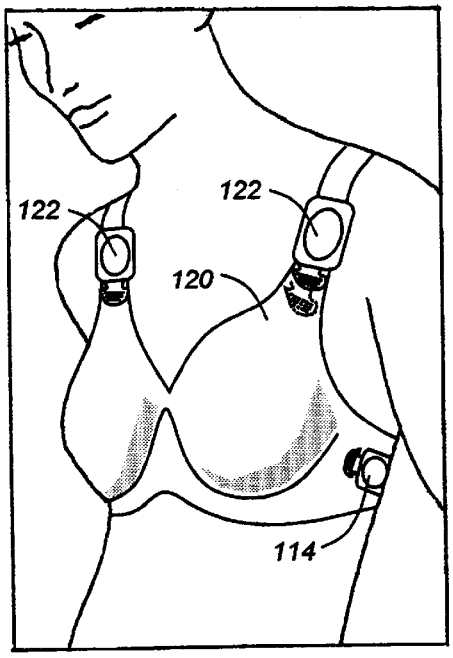
FIG. 12 is a drawing of a different alternative embodiment of the invention, wherein a brassiere includes a quick-release mechanism to at least temporarily loosen a brassiere when worn.

FIG. 12 illustrates a different version of the invention, wherein a brassiere 120 includes release points, preferably at the shoulder straps (122) and side panel (124). The wear pushes the buttons associated with these release points, allowing the garment to expand to loosen the garment. Preferably, such an expansion would be on the order of one inch or more, allowing the wearer to release tightness when driving, working, or at other times of relatively sedentary activities. When a person again becomes active, tabs associated with the release points may be pulled to return the garment to its original size.

Figure 13A:
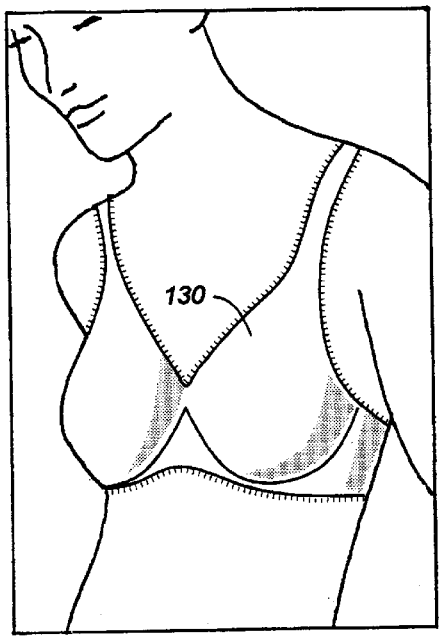
FIG. 13A is a drawing which shows how non-cup portions of a brassiere according to the invention would be increased as a function of cup size, and would include soft and flexible fabrics.
Figure 13B:
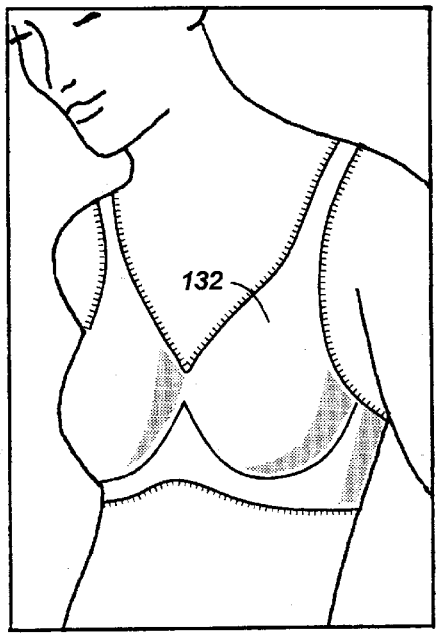
FIG. 13B shows the embodiment of FIG. 13A with a larger cup size.
Figure 13C:
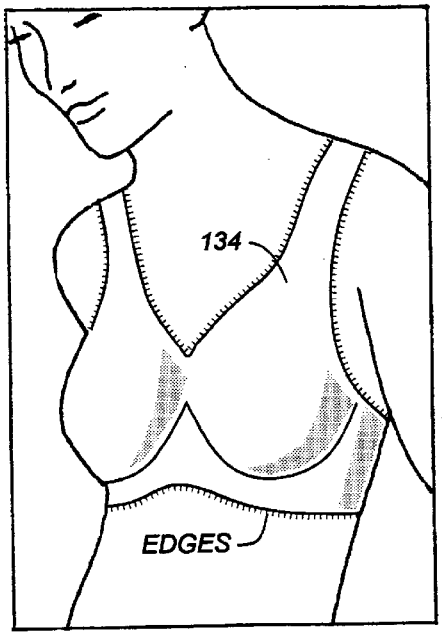
FIG. 13C is a drawing of the embodiments of FIG. 13A and 13B, with yet a larger cup size.
Figure 13D:
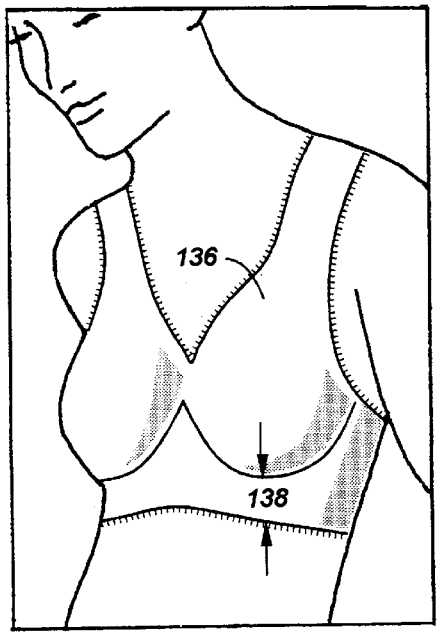
FIG. 13D is a drawing of the embodiments of FIGS. 13A–13C, with yet a larger cup size and associated bands and straps.

FIGS. 13A–13B illustrate yet a different alternative embodiment of the invention, wherein a brassiere 130 includes straps and a support bands which increase in size as the cup size increases and, in addition, the edges of the straps and support band are composed of a soft and flexible material to avoid restriction against the wearer's skin. FIG. 13A shows, for example, a brassiere 130 having a smaller cup size, with FIGS. 13B–13D showing garments 132 through 136, respectively, having increasingly larger straps and supporting band thicknesses. Note, for example, the width of the band 138 in FIG. 13D.

Figure 14:
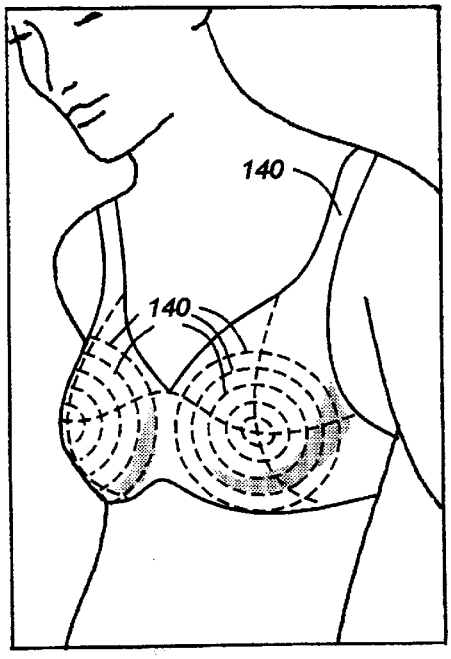
FIG. 14 is a drawing which illustrates yet a different alternative embodiment of the invention, wherein air- or liquid-filled bladders are sequenced to massage breast tissue and stimulate lymphatic flow.

FIG. 14 illustrates yet a further alternative embodiment of the invention, wherein a brassiere 140 includes air or liquid bladders 142 which fill and empty in sequence from the center to the outside of each breast. This massaging action would stimulate the flow of lymphatic fluid much like the vibration embodiment described with reference to FIG. 10. A miniaturized battery-operated pump and sequencing electronics would be located on the garment itself but removable therefrom when the garment is cleaned. The electronics and pneumatic or hydraulic sequencing system would be understood to one of skill in these arts, and could be based upon the types of pneumatic/hydraulic sequencing used in post-operative apparatus to minimize the occurrence of deep vein thrombosis, or DVT, as described in U.S. Pat. Nos. 4,013, 069; 4,453,538; 4,702,232. 4,841,956; 4,941,458; 5,014, 681; 5,263,473; and 5,674,262.

Figure 15:
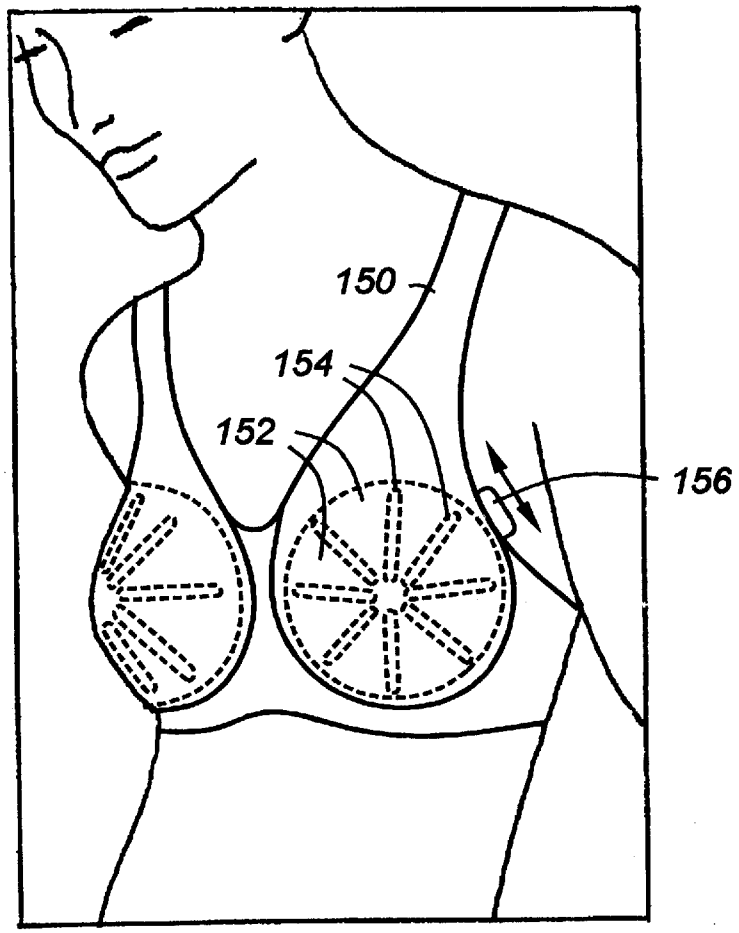
FIG. 15 is a drawing of yet a further alternative embodiment of the invention wherein the cups of a brassiere have ribs which radiate from the center and an optional insert to alter the orientation of the ribs.

FIG. 15 illustrates an additional alternative embodiment of the invention, wherein a brassiere 150 includes ribs 154 which radiate out from a central portion, forming areas of high and low pressure on the breast tissue. Areas 152, for example, represent areas of low pressure in the configurational shown. However, preferably with respect to this embodiment, means 156 would be included whereby the ribs 154 may be rotated or otherwise translated from time to time relative to the wearer's body, thereby changing the areas of high and low pressure to stimulate the flow of lymphatic fluid.

We claim:

1. A garment that facilitates the flow of lymphatic fluid through lymph drainage pathways in the breast of a human female, the garment comprising:

a piece of flexible material which, when worn, covers at least a portion of a human female breast; and at least one module supported on the garment to produce a tactile signal which is felt by the wearer on a periodic basis for temporarily relaxing or repositioning the garment relative to the lymph drainage pathways while the garment is worn.

2. The garment of claim 1, wherein the module is removable to permit laundering of the garment without the module.

3. The garment of claim 1, wherein the material forms part of a brassiere.

4. A garment that facilitates the flow of lymphatic fluid through lymph drainage pathways in the breast of a human female, the garment comprising:

a piece of flexible material which, when worn, covers at least a portion of a human female breast;

wherein the flexible material includes a pattern of alternating higher and lower skin-compression areas which correspond to the lymph drainage pathways; and means for adjusting the pattern to temporarily relax or reposition the garment when the garment is worn.

5. The garment of claim 4, wherein the material forms part of a brassiere.

6. The garment of claim 4, wherein:

the means for adjusting the pattern when the garment is worn includes air or liquid bladders which fill and empty in sequence.

7. The garment of claim 6, wherein:

the bladders are arranged radially from the center to the outside of each breast.

8. The garment of claim 7, wherein:

the material includes a pair of cup portions and pattern of alternating higher and lower skin-compression areas is in the form of ribs which radiate out from a central portion of each cup portion; and wherein the ribs may be manually rotated or otherwise translated on a periodic basis by the wearer.

9. A garment that facilitates the flow of lymphatic fluid through lymph drainage pathways in the breast of a human female, the garment comprising:

a piece of flexible material which, when worn, covers at least a portion of a human female breast;

the flexible material including a front section having two breast-receiving cup portions, two side panels, a back strap, and two shoulder straps connecting each cup portion to different points on the back strap; and wherein the peripheral edges of the side panels, a back strap, and shoulder straps have a soft and flexible material to avoid restriction against the wearer's skin, and the widths of the side panels, back strap, and shoulder straps are scaled upwardly as a function of increasing cup size.

10. The garment of claim 9, wherein the material forms part of a brassiere.

11. A garment that facilitates the flow of lymphatic fluid through lymph drainage pathways in the breast of a human female, the garment comprising:

a piece of flexible material which, when worn, covers at least a portion of a human female breast; and a multi-portion fastener for temporarily loosening a portion of the garment then returning the garment to its original tightness when worn.

12. The garment of claim 11, including:

side panels and two shoulder straps; and wherein the multi-position fastener includes release points at the shoulder straps.

13. The garment of claim 11, including:

side panels and two shoulder straps; and wherein the multi-position fastener includes release points at the side panels.

14. The garment of claim 11, wherein the material forms part of a brassiere.

15. A garment that facilitates the flow if lymphatic fluid through lymph drainage pathways in the breast of a human female, the garment comprising:

a piece of flexible material which, when worn, covers at least a portion of a human female breast; and one or more insets composed of an elastic fabric which is substantially more stretchable than the flexible material of the garment itself for temporarily relaxing or repositioning the garment relative to the lymph drainage pathways while the garment is worn.

16. The garment of claim 15, wherein the material forms part of a brassiere.

17. The garment of claim 15, including:

a front section having two breast-receiving cup portions, a back strap, and two shoulder straps extending from each cup portion to different points on the back strap; and an inset of the elastic fabric between the cup portions.

18. The garment of claim 15, including:

a front section having two breast-receiving cup portions, a back strap, and two shoulder straps connecting each cup portion to different points on the back strap; and an inset of the elastic fabric between the different points on the back strap.

19. The garment of claim 15, including:

a front section having two breast-receiving cup portions, a back strap, and two shoulder straps connecting each cup portion to different points on the back strap; and an inset of the elastic fabric between each cup portion and one of the points on the back strap.

* * * * *